US005454473A

United States Patent [19]

Hennessey

[11] Patent Number: 5,454,473

[45] Date of Patent: Oct. 3, 1995

[54] MULTIPLE INSTRUMENT-SUPPORTING STAND

[76] Inventor: James R. Hennessey, 7 Sunrise Hill Dr., West Hartford, Conn. 06107

[21] Appl. No.: 265,918

[22] Filed: Jun. 27, 1994

[51] Int. Cl.[6] ..... A47F 7/00

[52] U.S. Cl. ..... 211/13; 211/189

[58] Field of Search ..... 211/13, 189, 195, 211/196; 248/125, 170, 188.7, 188.6, 188.5, 309.1, 316.1, 316.5; 84/327

[56] References Cited

U.S. PATENT DOCUMENTS

| | | | |
|---|---|---|---|
| 4,205,818 | 6/1980 | Lawler | 211/13 X |
| 4,352,480 | 10/1982 | Gathright | 248/448 |
| 4,582,282 | 4/1986 | Gracie | 248/167 |
| 4,691,610 | 9/1987 | Gilbert | 248/168 |
| 4,943,021 | 7/1990 | Cien et al. | 248/167 |
| 5,116,005 | 5/1992 | LaGoy | 248/168 |
| 5,197,701 | 3/1993 | Olson | 248/166 |
| 5,346,073 | 9/1994 | Broersma et al. | 211/13 |
| 5,350,143 | 9/1994 | Hoshino | 248/166 |

*Primary Examiner*—Alvin C. Chin-Shue
*Assistant Examiner*—Sarah L. Purol
*Attorney, Agent, or Firm*—Ira S. Dorman

[57] ABSTRACT

A stand for supporting simultaneously one or more guitars consists of an upright post having three yokes at its upper end and three radially extending legs assembled on a hub at its lower end. Each leg carries a holding member, vertically aligned under a yoke and serving to receive the bottom strap knob of a guitar while its neck is received within the yoke. Collapse to a small configuration is achieved by moving one tubular piece of the upright post into another, and by moving both pieces through the hub of the leg assembly.

20 Claims, 7 Drawing Sheets

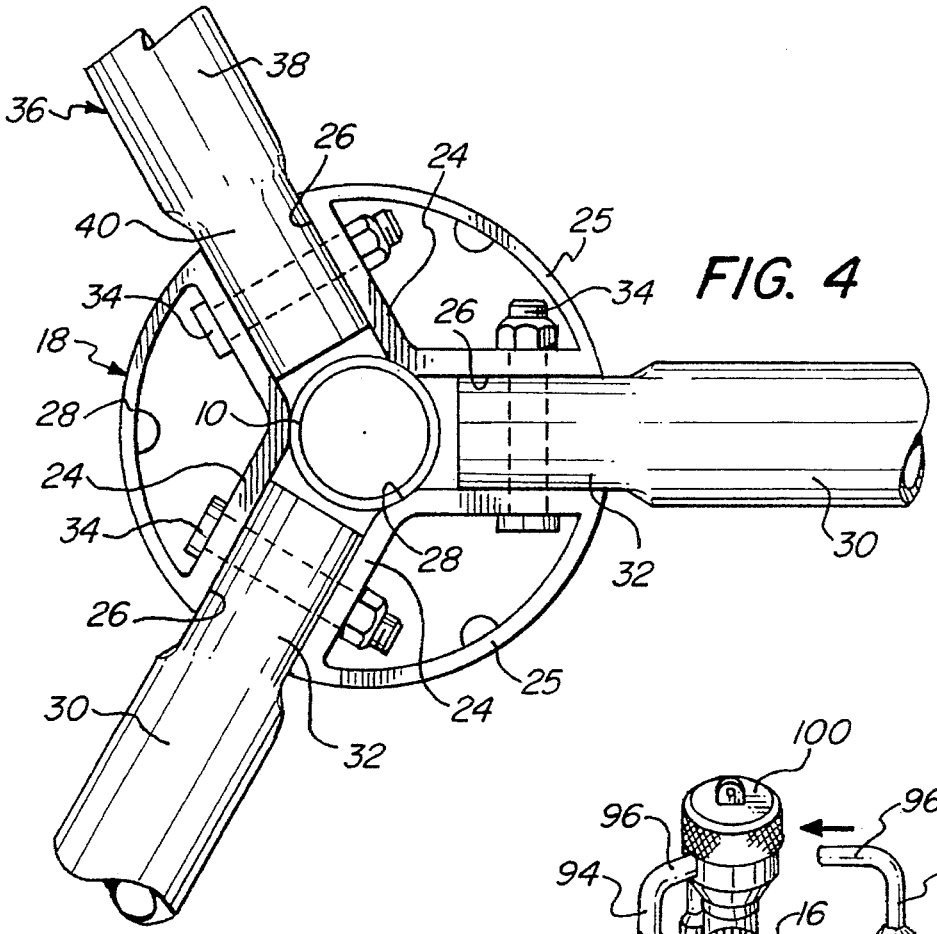
FIG. 4
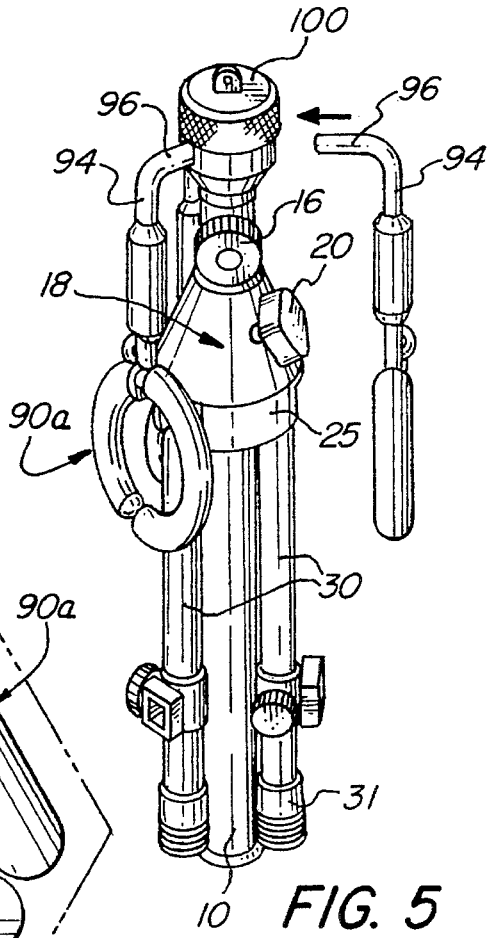
FIG. 5
FIG. 6
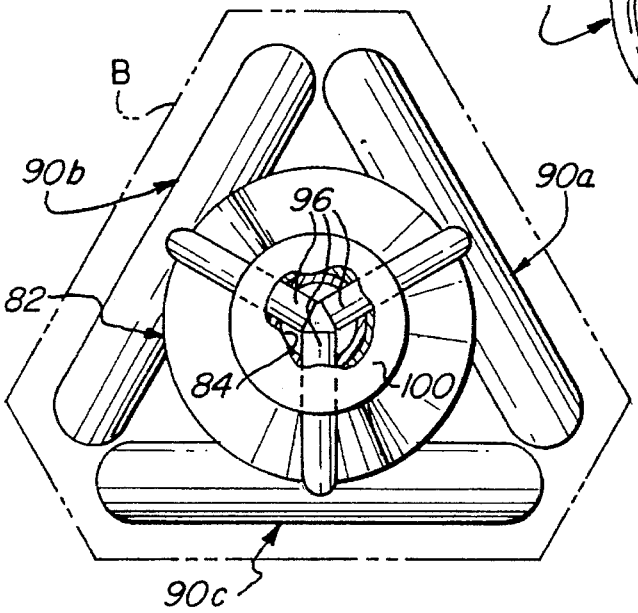

104
112
110
108
98
94
100
86
82
88
102
14
106
92
90a
96

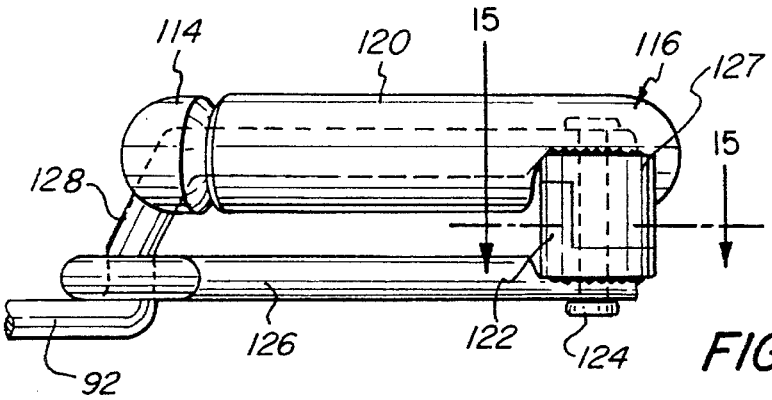
FIG. 13
FIG. 12
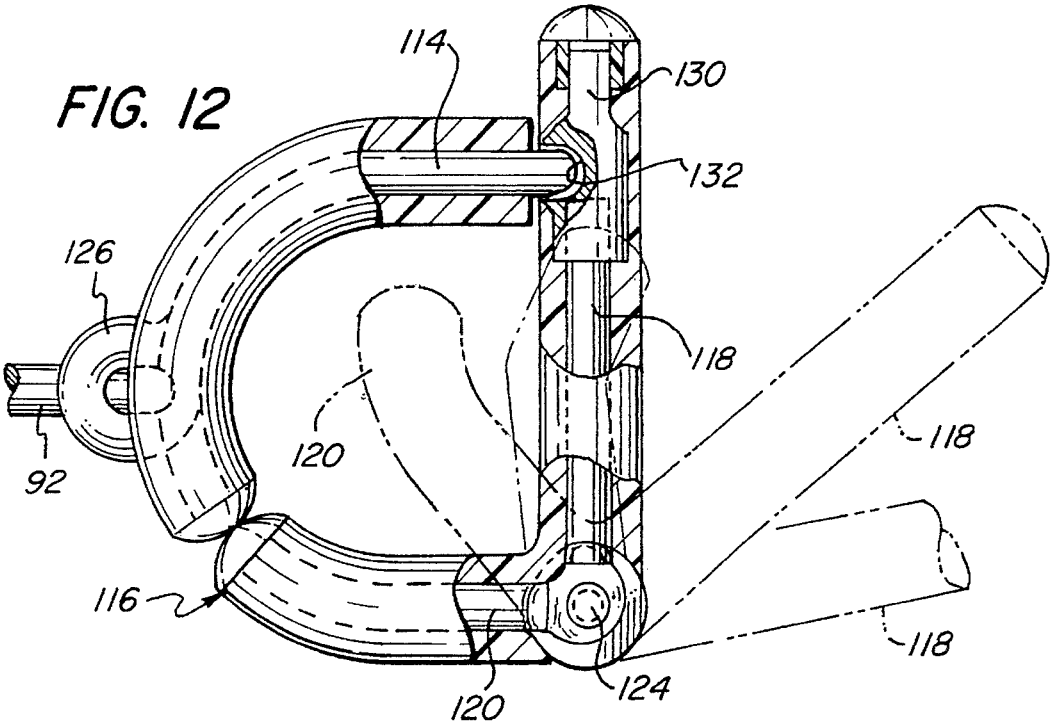
FIG. 15
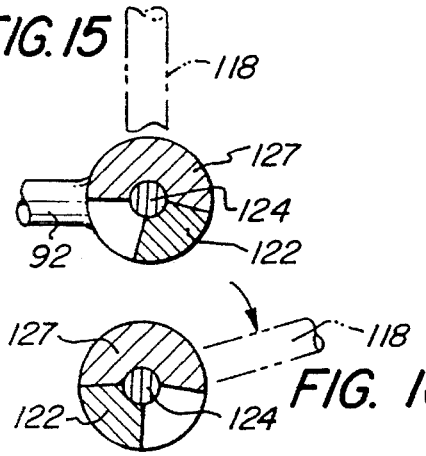
FIG. 16
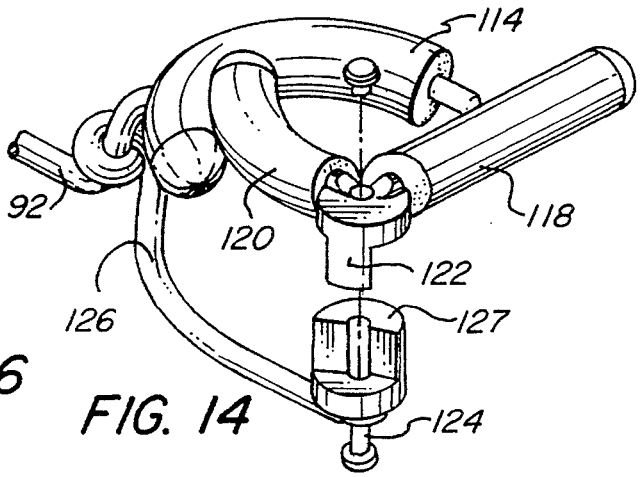
FIG. 14

MULTIPLE INSTRUMENT-SUPPORTING STAND

BACKGROUND OF THE INVENTION

Stands used for supporting musical instruments, such as guitars and keyboards, must be sturdy, strong, and stable. In most instances it will also be advantageous that they be so constructed as to permit collapse to a compact configuration. Such stands will preferably comprise a minimum number of disconnected pieces, they should be versatile (especially in respect of the number and styles of instruments that can be supported), and they will desirably afford a measure of security against unauthorized removal of the instruments.

SUMMARY OF THE INVENTION

Accordingly, it is the general object of the present invention to provide a novel stand that incorporates and affords the foregoing features and advantages.

A more specific object of the invention is to provide a stand that is adapted to be configured for the simultaneous support of one or more musical instruments, especially by engagement of the bottom strap knob, or strap lock fixture, of a guitar.

Additional objects are to provide such a stand by which the instruments are held in a very secure manner, and are yet readily accessible to the musician.

Further objects of the invention are to provide a musical instrument stand that is, in addition to the foregoing, relatively facile and inexpensive to manufacture, and convenient to employ.

It has now been found that certain of the foregoing and related objects of the invention are readily attained by the provision of a stand that comprises an upright member having a central axis; base structure for supporting the upright member with its central axis at an upright attitude; at least one holding member constructed for receiving and constraining the bottom strap knob of a musical instrument; and a plurality of engaging members disposed on the upright member and spaced above the base structure for releasably engaging the neck of the instrument. The holding member or members are arranged on the base structure at selected angular positions about the central axis of the upright member and radially outwardly thereof, and at least one of the engaging members is aligned vertically over one of the holding members to cooperate therewith in supporting the instrument.

Usually, the stand will include at least two engaging members, each vertically aligned with one of the holding members. The base structure may more specifically comprise at least three leg members that extend generally radially from the upright member at equiangularly spaced locations, with each leg member having a holding member thereon. The holding members and leg members will advantageously be constructed to permit variation of the radial distance of the holding members from the support member, and at least one of the leg members will desirably comprise a device that includes a manually releasable mechanism for engaging a strap lock fixture, to prevent its withdrawal.

In preferred embodiments, the upright member will be a post assembly comprised of two or more pieces, one of which is telescopically received within another for slidable movement on the central axis and for variable extension from its upper end. The base structure may comprise a hub member slidably mounted on the outer upright piece, and having at least three attached leg members at equiangularly spaced locations thereabout, the leg members being movable between positions extending radially outwardly from the hub member to generally parallel, downwardly extending positions. By making the pieces of the upright member and the leg members rectilinear and of substantially the same length, the stand can be collapsed to present it in a highly compact configuration.

In especially preferred embodiments the upper portion of the assembly will define an upwardly opening, axially extending well, and a plurality of upwardly opening slots extending radially from the well. Each engaging member will include a rigid shank having an outer end portion with instrument engaging means thereon, an inner, terminal end portion, and an intermediate portion directly adjacent the terminal end portion and disposed at substantially a right angle thereto. The slots in the upper portion of the assembly will be dimensioned and configured to receive and snugly seat both the intermediate and also the terminal portions of the engaging members, and the well therein will be dimensioned and configured to receive and seat simultaneously the terminal end portions of the shanks of all of the engaging members, with the intermediate portions thereof seated in the slots. As a result, the engaging members may be affixed on the upper portion of the post assembly with either the intermediate portions of the shanks or the terminal end portions thereof extending radially through the slots. A retaining member, engageable with the upper portion of the assembly to overlie the slots and retain the shank portions therewithin, will usually be provided.

The engaging means employed will advantageously take the form of a yoke, comprising substantially continuous, rigid, surrounding frame-forming structure. Such structure will include a stationary section operatively affixed to the shank and constituting a substantial portion of the peripheral length of the frame, and a displaceable section, the latter being movable between a first position in which it cooperates with the stationary section to complete the periphery of the frame, and a second position in which it opens the frame and provides access to the area defined therewithin.

BRIEF DESCRIPTION OF THE DRAWINGS

FIG. 4 is a fragmentary bottom view of the stand of FIG. 1;

FIG. 5 is a perspective view of the stand of FIG. 1 in collapsed configuration and drawn to the scale thereof;

FIG. 6 is a plan view of the collapsed stand contained within a box, depicted in phantom line, a portion of the retaining cap being broken away to show the relationship of underlying elements;

Figure 1:
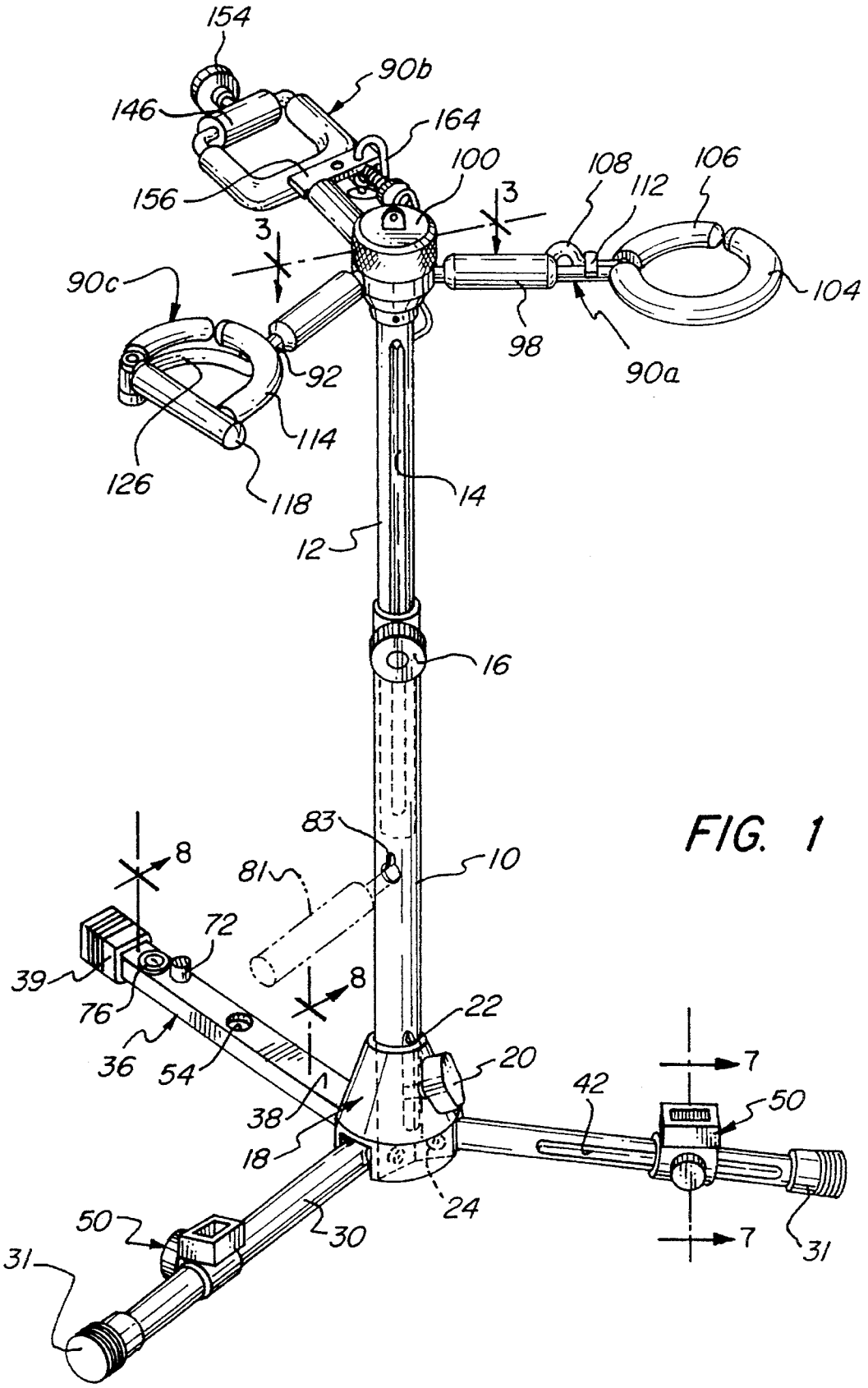
FIG. 1 of the drawings is a perspective view of a musical instrument stand embodying the present invention, shown in erected configuration for simultaneously supporting three guitars, or similar instruments.
Figure 9:
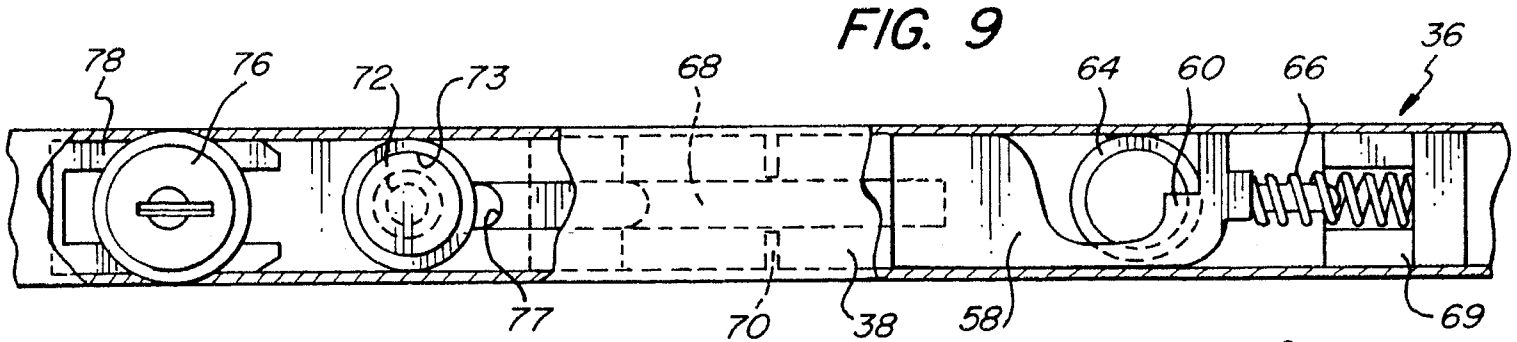
Figure 8:
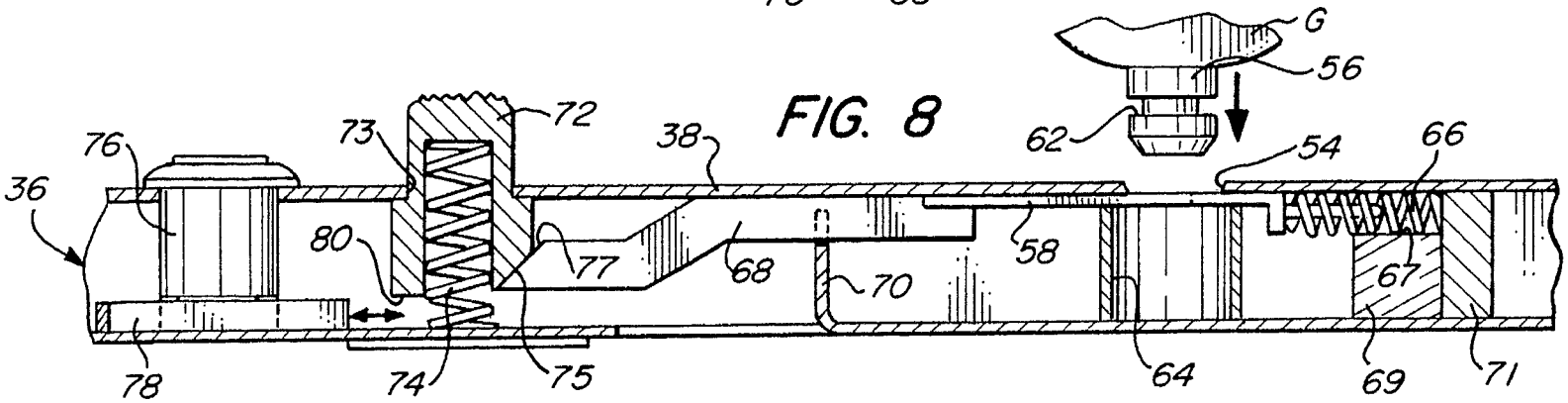
Figure 7:
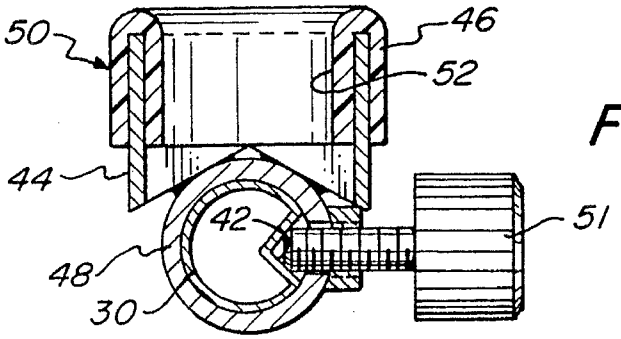
FIG. 7 is a sectional view taken along line 7—7 of FIG.
Figures 10, 11:
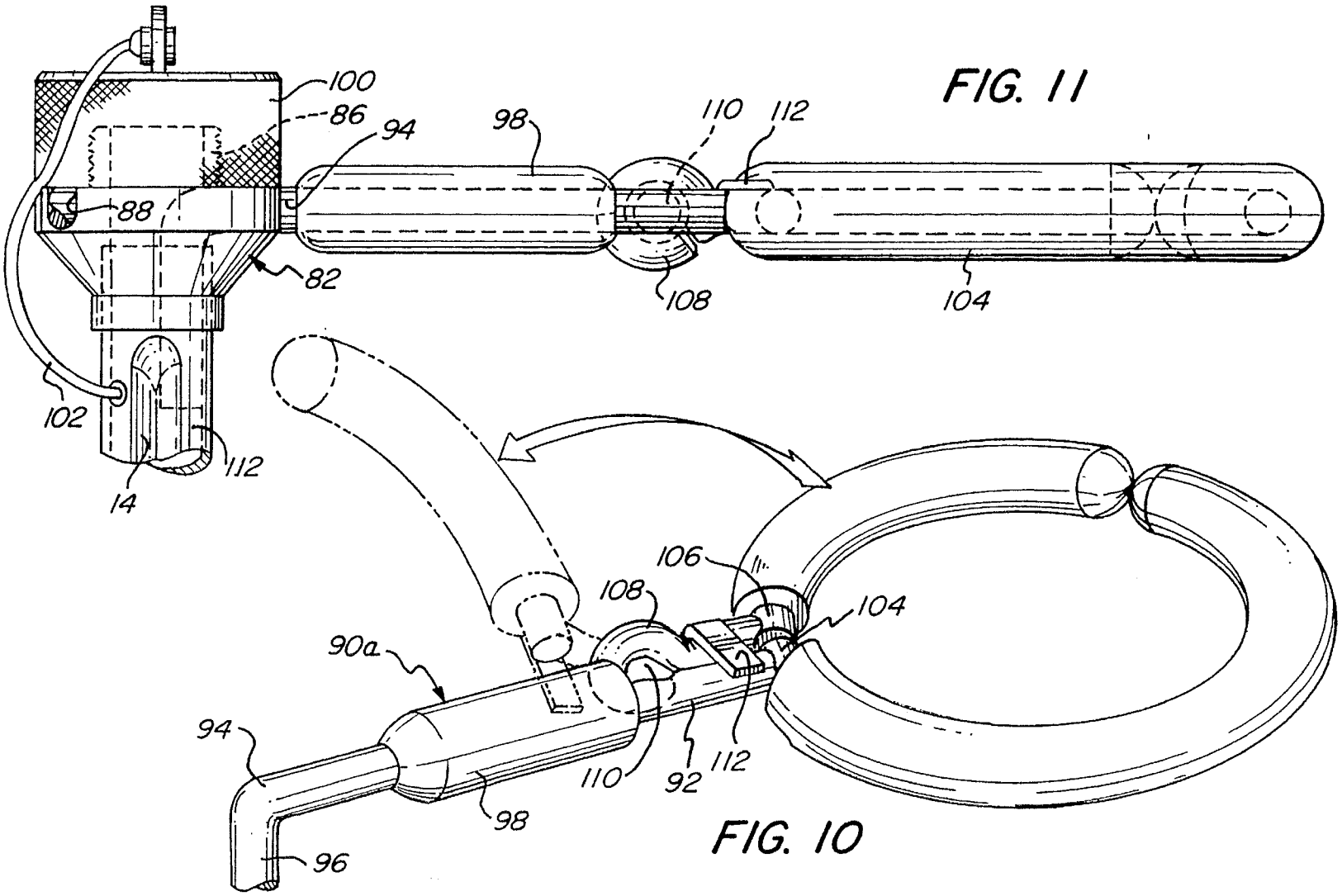
Figure 17:
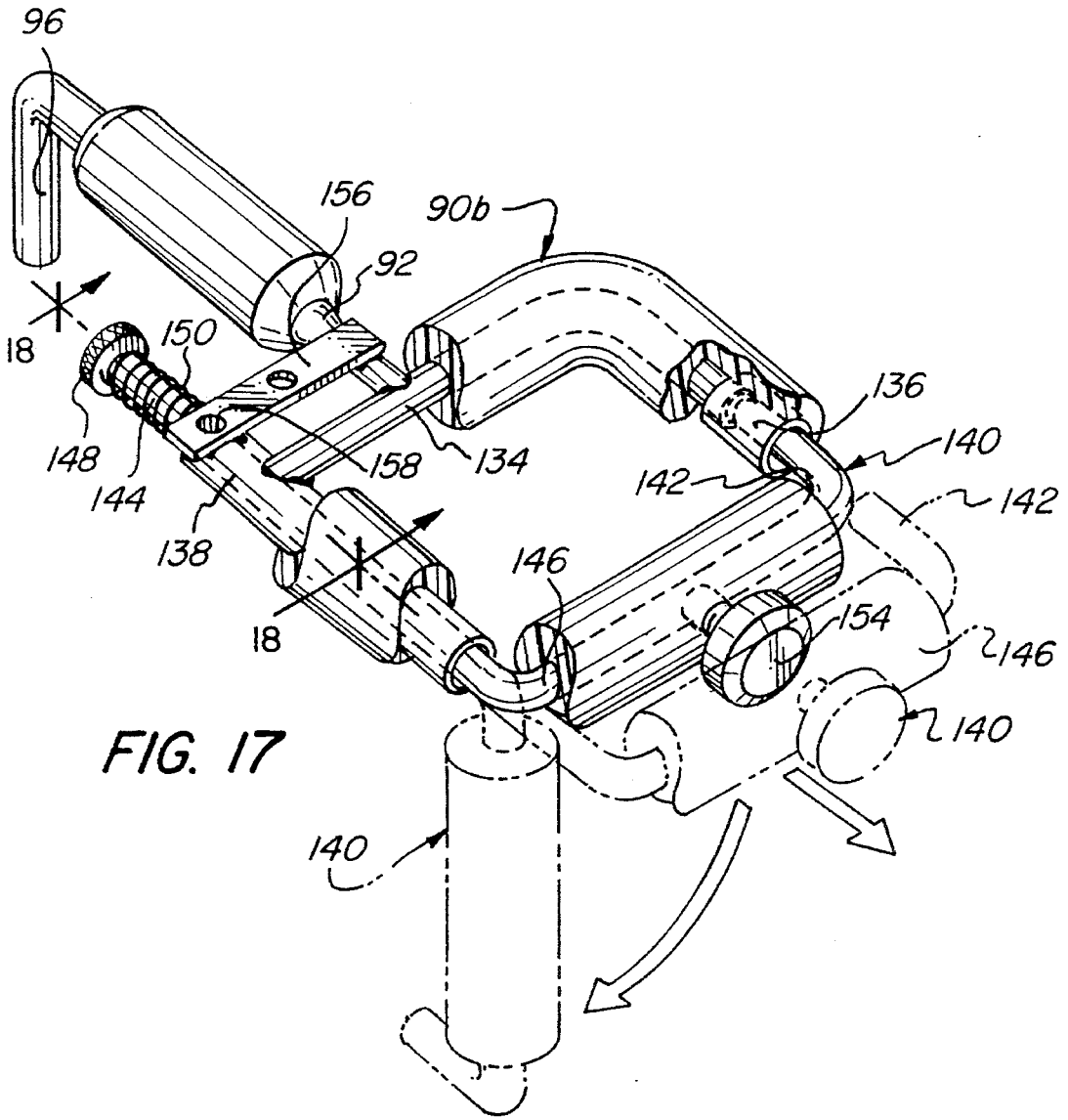
Figure 18:
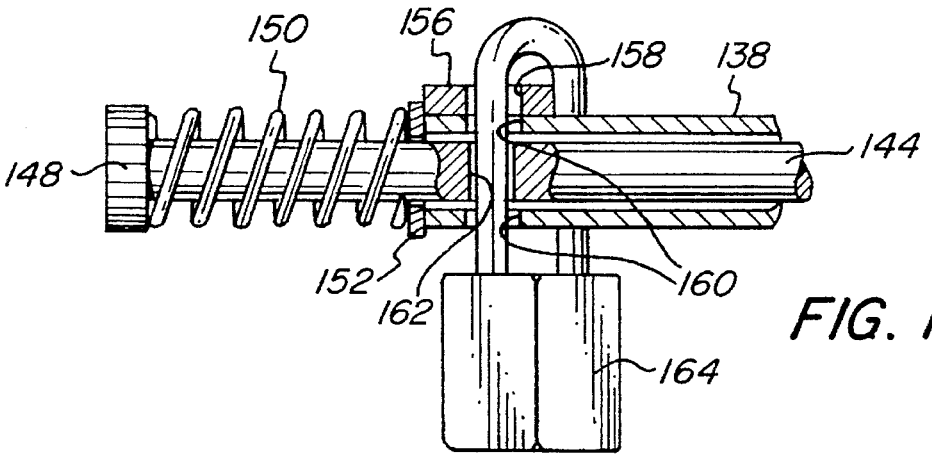

1 and drawn to an enlarged scale;

FIG. 8 is a fragmentary sectional view taken along line 8—8 of FIG. 1 and drawn to a scale enlarged therefrom, the Figure showing a bottom portion of a guitar body positioned for insertion of its strap lock fixture into the engaging device contained within the stand leg;

FIG. 9 is a fragmentary plan view of the leg depicted in FIG. 8, with portions broken away to show underlying features;

FIG. 10 is a fragmentary perspective view showing one of the yokes on the stand of FIG. 1, consisting of a movable part shown in full line in its closed position and in the plane of the stationary part, and shown in phantom line in a pivotably displaced, open position;

FIG. 11 is a fragmentary side elevational view of the yoke of FIG. 10, mounted within the head of the stand post;

FIGS. 12 and 13 are, respectively, fragmentary plan and side elevational views of a second form of yoke, again consisting of two parts with the closed position of the movable part shown in full line in FIG. 12 and with open positions being shown in phantom line;

FIG. 14 is an exploded perspective view of the yoke of the preceding two Figures, drawn to a reduced scale;

FIGS. 15 and 16 are sectional views taken along line 15—15 of FIG. 13, showing the relationships of the hub portion of the movable part of the yoke in its fully closed and fully open positions;

FIG. 17 is a fragmentary perspective view of a third form of yoke with portions broken away to show underlying features, the movable part of the yoke again being depicted in full line in its closed position and in phantom line in open positions; and FIG. 18 is a sectional view taken along line 18—18 of FIG. 17, showing a padlock attached to the yoke.

DETAILED DESCRIPTION OF THE PREFERRED AND ILLUSTRATED EMBODIMENTS

Turning initially to FIGS. 1 through 9 of the drawings, therein illustrated is a musical instrument stand embodying the present invention. It consists of an upright post assembly including an outer tube 10 and an inner tube 12 telescopically received therewithin, the inner tube 12 having a groove 14 formed along substantially its entire length for engagement of the tip of a thumb screw 16, the latter serving both to affix the tube 12 at a selected height and also to prevent relative rotation of the components (rectangular tubing may of course serve the latter purpose, if preferred).

A generally frustoconical hub piece 18 is disengageably secured by thumb screw 20 at the bottom of the outer tube 10, which is formed with a short groove 22 serving, in cooperation with the thumb screw 20, functions comparable to groove 14 and screw 16. Three wide V-shaped inner wall elements 24 cooperate with the depending skirt elements 25 of the hub piece 18 to define three downwardly and radially outwardly opening channels 26, at 120° intervals thereabout; the elements 24 also define a central, axially-extending passageway 28 for stabilizing the lower end portion of the outer tube 10.

The base structure of the stand further includes two tubular legs 30 of circular cross section, each having a protective cap 31 at its outer end and a flattened inner end portion 32 dimensioned and configured to seat within one of the radially-extending channels 26. A nut-and-bolt fastener 34 extends transversely between opposing portions of the wall elements 24 and through the flattened portions 32 of the legs 30 to support them for pivotable movement between erected positions, extending radially outwardly of the hub piece 18, and collapsed positions extending downwardly therefrom and generally parallel to one another (as depicted in FIG. 5).

A third leg, generally designated by the numeral 36, is constructed from a tubular piece 38 of rectangular cross section, and has a correspondingly configured cap 38 on its outer end and a portion 40 on its inner end formed to seat within one of the channels 26. It will of course be appreciated that the legs may all be the same, or combinations of different styles may be employed, as preferred.

Each of the legs 30 carries a holding member, generally designated by the numeral 50, which consists of a box-like receiving part 44 of rectangular cross section (albeit that the part may be circular, or of other shapes) and a cylindrical mounting part 48, the latter serving to slidably mount the holding member on the leg 30. A thumb screw 51 extends through the mounting part 48 and into engagement with a groove 42 formed along the length of the leg, serving to affix the holding member with an upwardly opening orientation at any selected point therealong. The wall from which the part 44 is fabricated is protected by a cushioning element 46, which lines the recess 52 thereof; the recess is dimensioned and configured to receive and laterally constrain the strap lock fixture 56 provided on the bottom of the body of a guitar G, shown in FIG. 8, and is a specific form of the knobs that are conventionally used for engagement of one end of the guitar neck strap.

The tubular piece 38, of which the third leg 36 is comprised, has a circular opening 54 formed through its upper wall, below which a locking plate 58 is slidably supported by an upstanding cylindrical element 64. The plate 58 is formed with a tongue portion 60, which is dimensioned and configured to seat within the circumferential groove 62 formed in the strap lock 56. A coil spring 66, retained within a recess 67 defined by elements 69 and 71, urges the locking plate 58 in a radially outward direction so as to normally engage a strap lock 56 inserted through the opening 54. Operating finger 68 is slidably supported upon an upstanding wall element 70, and may be shifted inwardly against the force of spring 66 by the foot-operated button 72, which projects through a second hole 73 in the wall of the piece 38 and is urged upwardly by a coil spring 74. Force upon the button 72 is transmitted through the mating oblique surface elements 75 and 77 on the button 72 and finger 68, respectively, to shift the plate 58 and thereby to effect release of the strap lock 56. Unauthorized operation may be prevented by use of a lock 76, which is key-operated to cause a U-shaped space-bar 78 to slide under the bottom surface 80 of the button 72, thereby preventing its depression.

FIG. 1 shows, in phantom line, an accessory arm 81, which is received in a key-hole slot 83 in the tube 10. The arm 31 is designed specifically for supporting a guitar having a V-indented body, within which the arm 81 may be seated as a means for providing underlying support, in lieu of a holding member 50.

Figure 2:
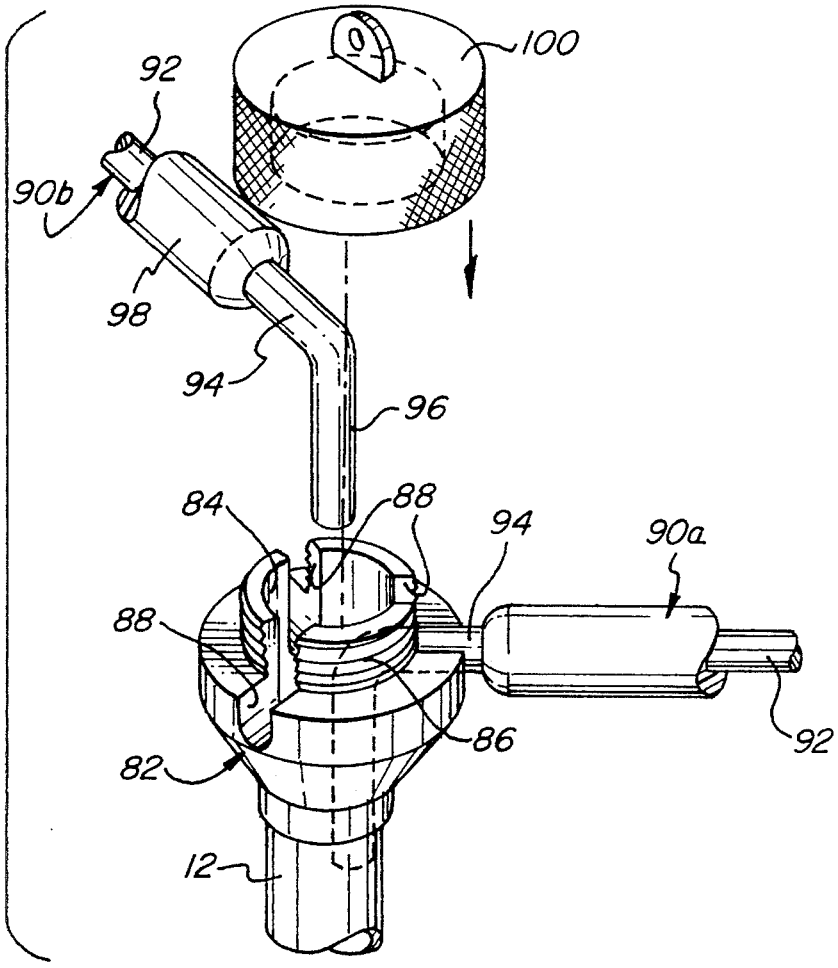
FIG. 2 is a fragmentary perspective view, drawn to a scale enlarged from that of FIG. 1, showing the upper portion of the center support post and two instrument-engaging yokes, one of the yokes and the retaining cap being depicted in exploded relationship and the other begin shown assembled in the head of the post.
Figure 3:
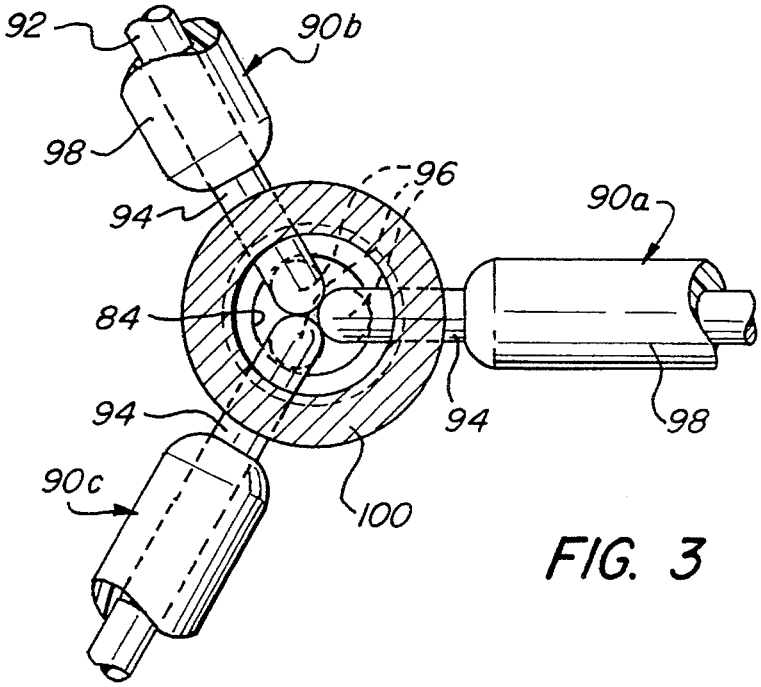
FIG. 3 is a fragmentary sectional view taken along line 3—3 of FIG. 1.

The mounting head of the stand, generally designated by the numeral 82 and affixed on the upper end of the inner tube 12, is best seen in FIGS. 2 and 3. A bore through the head 82 provides a circular well 84, partially defined by a threaded upper collar portion 86. Three upwardly opening slots 88 extend at 120° intervals radially through the head 82, and serve to receive shank portions of three neck-supporting yokes, generally designated by the numerals 90*a*, 90*b*, and 90*c*. Each yoke (further details of which will described hereinbelow) includes a shank 92 having a rectilinear intermediate portion 94 and a rectilinear terminal portion 96 extending at a right angle thereto; a padded section 96 cushions the underlying structure and facilitates handling of the yoke. The channels 88 are dimensioned and configured to snugly seat both of the portions 94 and 96 of the shanks 92, thereby enabling mounting of the yokes in either the radially extending, erected positions shown in FIGS. 1 through 3 (with the terminal portions 96 extending axially within the well 84), or in a stowed position with the terminal portions 96 extending radially and the adjacent portions 94 extending axially along the outside of the tube 12, as shown in FIG. 5.

When the shanks of the yokes are properly seated the cap 10 is threadably engaged upon the portion 86 of the head 82 (which may be tethered thereto by a flexible cable 102), so as to retain the yokes in place. It will be appreciated from FIGS. 3 and 6 that the space within the passage 84, and the length of the terminal portions 96, are such that each yoke may be selectively and independently secured in either its extended or its collapsed (stowed) position.

As noted previously, FIG. 5 shows the stand in its fully collapsed and most compact configuration. FIG. 6 shows it contained within a carton or box, designated "B".

Turning now to FIGS. 10 and 11 of the drawings, therein illustrated is a yoke 90 of unique construction and suitable for use in the instant stand. It consists of circular frame-forming structure, the components of which are fabricated from the same material (normally, bent steel rod) as the shank 92 and are covered by a cushioning material (unnumbered). A first component 104 is rigidly attached to the shank 92, and advantageously circumscribes an arc of about 250° to 270°. The other component 106 completes the circle, and has an attached hook-like piece 108 encircling a stub axle 110 on the shank 92 to permit pivoting of component 106 between the positions shown in FIG. 10. A laterally extending tab 112 prevents passage of the component 106 beyond the raised position illustrated (typically 50° to 60° past vertical), and in the other direction beyond a coplanar relationship with the component 104, wherein they cooperatively define a substantially continuous frame adapted to surround the neck of a supported guitar. Needless to say, when access is desired the component 106 is simply pivoted upwardly and away from the component 104, where it will rest on the tab 112 until being returned to its closed position.

FIGS. 12 through 15 illustrate a second form of novel yoke, which consists of a stationary, J-shaped component 114 and a movable L-shaped gate component, generally designated by the numeral 116 and consisting of elements 118, 120 affixed in a right-angular relationship to a hinge element 122. An arm 126 is attached to an upstanding portion 128 of the shank 92 and has a mating hinge element 127 at its free end which cooperates with the element 122 and the rivet 124 to hingedly mount the gate component 116. A locating piece 130 is attached to the free end of the element 118, into which a shallow socket 132 is formed for receiving the tip of the component 114 when the yoke is in closed relationship.

FIG. 12 depicts stages of opening of the gate component 116, it being appreciated that merely shifting the neck of the supported instrument forwardly against the element 118 and away from the stationary component 114 will effect opening. The component 116 will remain in its fully rotated position (as limited by the hinge structure shown in FIGS. 15 and 16), so that again the instrument itself need only be pushed gently inwardly against the element 118 to close the gate component and to thereby capture the neck of the instrument within the yoke.

Turning finally to FIGS. 17 and 18, a third yoke 90*b* of unique construction is shown in detail, and comprises an L-shaped component 134 attached to the shank 92, and a J-shaped component generally designated by the numeral 140. A cylindrical collar 136 is attached to one end of component 134 and a cylindrical sleeve 138 is supported on its other end. Terminal element 142 of component 140 is normally engaged within the collar 136 of component 134 when the yoke is in its closed configuration, and elongate mounting component 144 is slidably engaged within the sleeve 138; a handle knob 154 is attached to the connecting element 146. Coil spring 150 is retained by head 148 on the free end of element 144 with its opposite end bearing upon a washer 152 on the end of the sleeve 138, thereby urging the component 140 toward the closed position of the yoke.

Disengagement of the component 140 is effected by exerting withdrawing force upon the handle knob 154, thus permitting it to be pivoted within the sleeve 138 to afford access into the remaining frame structure (as shown by the phantom line representations of FIG. 17). A locking plate 156 is attached to the shank 92 and extends laterally over the sleeve 138. Aligned apertures 158, 160 and 162 in the plate 156, the sleeve 138, and the element 144, respectively, serve to receive the link of a padlock 164, preventing withdrawal of the component 140 and thereby unauthorized access to the instrument.

Thus, it can be seen that the present invention provides a novel stand that incorporates and affords the features and advantages first mentioned hereinabove. The stand may be configured for the simultaneous support of one or more musical instruments, especially by engagement of the bottom strap knob, or locking fixture, of a guitar. It will also be appreciated however that elements other than yokes of the kind described may be employed; e.g., structures having spread fingers disposed effectively in a common plane may provide underlying support for a keyboard. The instruments are in any event held in a very secure and yet readily accessible manner, and the stand is relatively facile and inexpensive to manufacture, and convenient to employ.

Having thus described the invention, what is claimed is:

1. A stand adapted for supporting simultaneously a plurality of guitars, or like musical instruments having a neck and a strap knob at opposite ends of their bodies, comprising: an upright member having a central axis; base structure for supporting said upright member with said central axis at an upright attitude; at least one holding member constructed for receiving and constraining the bottom strap knob of a musical instrument, said holding member being disposed on said base structure at a selected angular position about said central axis and radially outwardly thereof; and at least one engaging member disposed on said upright member and spaced above said base structure for releasably engaging the neck of a said musical instrument, said engaging member being aligned vertically over said holding member to cooperate therewith in supporting a musical instrument.

2. The stand of claim 1 wherein at least two of said engaging members and at least two of said holding members are provided and are vertically aligned with one another.

3. The stand of claim 2 wherein said base structure comprises at least three leg members extending generally radially from said upright member at fixed equiangularly spaced locations thereabout.

4. The stand of claim 3 wherein said holding members and said leg members are constructed to permit variation of the radial distance between said holding members and said upright member.

5. The stand of claim 3 wherein one of said leg members comprises a holding device including one of said holding members, said device comprising a manually releasable mechanism for engaging against withdrawal of a said knob received in said one holding member.

6. The stand of claim 5 wherein said holding device further includes locking means for preventing the unauthorized operation of said releasable mechanism.

7. The stand of claim 1 wherein said upright member is a post assembly comprised of a plurality of pieces having upper and lower ends, one of said pieces being telescopically received within another of said pieces for slidable movement on said central axis and for variable extension from said upper end of said another piece; and wherein said base structure comprises a hub member slidably mounted on said another piece of said post assembly, and at least three leg members attached to said hub member at equiangularly spaced locations thereabout, said leg members being movable between positions extending radially outwardly from said hub member and positions extending downwardly therefrom and generally parallel to one another and to said central axis, and said hub member being affixable adjacent said lower end of said another member, said pieces of said post assembly, and said leg members, all being generally rectilinear and of substantially the same length, whereby said one piece can be substantially contained within said another piece and said hub member can be moved on said another piece to a position adjacent said upper end thereof with said leg members extended therealong, said stand thereby being presented in a highly compact configuration.

8. The stand of claim 7 wherein said one and another pieces of said post assembly, and said another piece and said hub member, respectively, have means thereon for interengaging them against relative rotation about said central axis when said stand is in an erected configuration, thereby ensuring vertical alignment of said engaging and holding members.

9. The stand of claim 3 wherein said stand has three said engaging members and three said leg members, each of said engaging members being vertically aligned over one of said holding members.

10. The stand of claim 9 wherein said hub member has an opening through which said another piece of said post assembly extends, and includes wall elements having wall portions defining radially outwardly and downwardly opening channels therebetween for receiving inner end portions of said leg members, each of said leg members having an inner end portion received in one of said channels and pivotably affixed between said wall portions defining the same, said wall elements also having bearing portions providing bearing surfaces that extend axially from adjacent said opening of said hub for engagement with the outer surface of said another piece extending therethrough.

11. The stand of claim 1 wherein said post assembly includes an upper portion that defines an upwardly opening, axially extending well and a plurality of upwardly opening slots extending from said well radially through said upper portion; and wherein said stand includes a plurality of said engaging members, each including a rigid shank having an outer end portion with engaging means thereon, an inner, terminal end portion, and an intermediate portion directly adjacent said terminal end portion and disposed at substantially a right angle thereto, each of said slots being dimensioned and configured to receive and snugly seat both said terminal end portion and also said intermediate portion of said shank of at least one of said engaging members, and said well being dimensioned and configured to receive and seat simultaneously said terminal end portions of said shanks of all said engaging members with said intermediate portions thereof seated in said slots; whereby said engaging members may be affixed on said upper portion of said post assembly selectively with either said intermediate portions of said shanks or said terminal end portions thereof seated in and extending radially through said slots.

12. The stand of claim 11 wherein said post assembly further includes a retaining member engageable with said upper portion to overlie said slots and retain said intermediate portions or terminal end portions of said shanks therewithin.

13. The stand of claim 11 wherein said engaging means of at least one of said engaging members is a yoke comprised of substantially continuous, rigid, surrounding frame-forming structure, said structure including a stationary section operatively affixed to said shank of said yoke and constituting a substantial portion of the peripheral length of said frame, and a displaceable section that is movable between a first position in which it cooperates with said stationary section to complete the periphery of said frame, and a second position in which it opens said yoke and provides access to the area defined within said frame-forming structure.

14. The stand of claim 13 wherein said structure lies substantially in a plane, and wherein said displaceable section is pivotably mounted for movement out of said plane.

15. The stand of claim 13 wherein said structure lies substantially in a plane, and wherein said displaceable section is pivotably mounted for movement within said plane, said displaceable section consisting of two portions, each extending from the point of pivotable mounting.

16. The stand of claim 13 wherein said structure lies substantially in a plane, and wherein said displaceable section is pivotably mounted for movement out of said plane; said structure including elements telescopically interengaging adjacent end portions of said sections when said displaceable section is in said first position thereof, said displaceable section being mounted for movement away from said stationary section to disengage said adjacent end portions and thereby permit such pivotable movement of said displaceable section.

17. The stand of claim 13 wherein said at least one engaging member further includes locking means for preventing unauthorized movement of said displaceable section from said first position thereof.

18. A stand for supporting simultaneously a plurality of musical instruments, comprising a center support member having a central axis; base structure for supporting said support member with said central axis at an upright attitude; and a plurality of engaging members disposed on said support member and spaced above said base structure for releasably engaging a portion of the supported instrument; said upright member being a post assembly comprised of a plurality of pieces having upper and lower ends, one of said pieces being telescopically received within another of said pieces for slidable movement on said central axis and for variable extension from said upper end of said another piece; and said base structure comprising a hub member slidably mounted on said another piece of said post assembly, and at least three leg members attached to said hub member at equiangularly spaced locations thereabout, said leg members being movable between positions extending radially outwardly from said hub member and positions extending downwardly therefrom and generally parallel to one another and said central axis, and said hub member being affixable adjacent said lower end of said another member, said pieces of said post assembly, and said leg members, all being generally rectilinear and of substantially the same length, whereby said one piece can be substantially contained within said another piece, and whereby said hub member can be moved on said another piece to a position adjacent said upper end thereof with said leg members extended therealong, said stand thereby being presenting in a highly compact configuration.

19. The stand of claim 18 wherein said hub member has an opening through which said another piece of said post assembly extends, and includes wall elements having wall portions defining radially outwardly and downwardly opening channels therebetween for receiving inner end portions of said leg members, each of said leg members having an inner end portion received in one of said channels and pivotably affixed between said wall portions defining the same, said wall elements also having bearing portions providing bearing surfaces that extend axially from adjacent said opening of said hub for engagement with the outer surface of said another piece extending therethrough.

20. The stand of claim 18 wherein said post assembly includes an upper portion that defines an upwardly opening, axially extending well and a plurality of upwardly opening slots extending from said well radially through said upper portion; and wherein each of said engaging members includes a rigid shank having an outer end portion with engaging means thereon, an inner, terminal end portion, and an intermediate portion directly adjacent said terminal end portion and disposed at substantially a right angle thereto, each of said slots being dimensioned and configured to receive and snugly seat both said terminal end portion and also said intermediate portion of said shank of at least one of said engaging members, and said well being dimensioned and configured to receive and seat simultaneously said terminal end portions of said shanks of all said engaging members with said intermediate portions thereof seated in said slots; whereby said engaging members may be affixed on said upper portion of said post assembly selectively with either said intermediate portions of said shanks or said terminal end portions thereof seated in and extending radially through said slots.

* * * * *